United States Patent [19]

Partlow et al.

[11] Patent Number: 4,602,956

[45] Date of Patent: Jul. 29, 1986

[54] CERMET COMPOSITES, PROCESS FOR PRODUCING THEM AND ARC TUBE INCORPORATING THEM

[75] Inventors: Deborah P. Partlow; Shih-Ming Ho, both of Pittsburgh, Pa.

[73] Assignee: North American Philips Lighting Corporation, New York, N.Y.

[21] Appl. No.: 682,115

[22] Filed: Dec. 17, 1984

[51] Int. Cl.[4] ..... C22C 29/12

[52] U.S. Cl. ..... 75/235; 75/228; 75/232; 148/126.1; 148/127; 419/6; 419/19; 419/30; 419/39; 419/57; 419/66; 428/565; 428/615; 428/621; 428/649; 428/651; 428/689

[58] Field of Search ..... 419/5, 6, 19, 30, 39, 419/57, 66; 148/126.1, 127; 75/235, 228, 232; 428/615, 621, 565, 649, 651, 689

[56] References Cited

U.S. PATENT DOCUMENTS

| | | | |
|---|---|---|---|
| 3,780,418 | 12/1973 | Horst | 419/6 |
| 4,299,627 | 11/1981 | Shinohara et al. | 419/19 |
| 4,478,787 | 10/1984 | Nadkarni et al. | 75/235 |

*Primary Examiner*—Stephen J. Lechert, Jr.
*Attorney, Agent, or Firm*—John C. Fox

[57] ABSTRACT

Composite cermets having a central core of a first cermet composition and one or more surrounding layers of different cermet compositions are formed by a multistep pressing operation, followed by sintering. A tungsten/alumina or molybdenum/alumina composite cermet is useful as an end closure for alumina arc tubes of metal halide discharge lamps.

12 Claims, 3 Drawing Figures

CERMET COMPOSITES, PROCESS FOR PRODUCING THEM AND ARC TUBE INCORPORATING THEM

BACKGROUND OF THE INVENTION

This invention relates to cermets, and more particularly relates to composite cermets having one or more layers around central core, and also relates to a process for producing them and to a lamp incorporating them.

Development of a new higher-temperature metal halide lamp requires the substitution of a ceramic arc tube, often polycrystalline alumina (PCA), for the usual fused silica arc tube, which cannot withstand these higher tempertures. Closure for the PCA tubes must have thermal expansion characteristics similar to $Al_2O_3$, while at the same time providing a method for electrical connection to the lamp electrode. Thus, the closure material would ideally have PCA-like thermal expansion characteristics but metal-like electrical conductivity. A further complicating factor is that the closure material must also be chemically resistant to the metal halide environment. This would eliminate Nb as the closure material even though it could satisfy both the thermal expansion and conductivity requirements, as Nb reacts rapidly with the halogens.

The problem of chemical resistance is circumvented by choosing closure materials which are already acceptable as other lamp components: $Al_2O_3$, the arc tube material, and W or Mo, the electrode and feed-through materials. A simple mixture of $Al_2O_3$ with a small amount of W or Mo will not suffice, as approximately 20 volume percent (55 weight percent) of W, for example, is required to achieve acceptable conductivity. a ceramic/metal mixture (cermet) of such high metal content (see, e.g., U.S. Pat. No. 4,001,625) will not exhibit ceramic thermal expansion behavior, however, and problems in achieving a leak-proof closure will likely occur. On the other hand, use of lower percentages of metal will yield materials of unacceptably low conductivity; if a continuous metal feed-through which extends through the closure is used, expansion mismatch causes problems with leaks around the feed-through.

A more complex approach is represented by U.S. Pat. Nos. 4,155,757; 4,155,758 and 4,354,964. In the '964 patent, for example, a refractory metal-oxide cermet with an unusually high conductivity is achieved by forming a continuous conductive network of the refractory metal surrounding the oxide granules. This is achieved by coating relatively coarse refractory metal oxide granules with fine metal powder, compacting and sintering the powder compact. As will be appreciated, producing such a cermet requires close control over process parameters, especially particle sizes of the constituents.

It is accordingly an object of the invention to provide refractory metal-aluminum oxide cermets having both relatively high electrical conductivities and low thermal expansion coefficients, which cermets may be used as end closures for alumina arc tubes in metal halide lamps.

It is a further object of the invention to provide composite cermets having a combination of physical, chemical and electrical properties which are unattainable in one or more of the constituent materials, which cermets may be readily produced by compacting and sintering of powder constituents.

SUMMARY OF THE INVENTION

In its broadest aspects, the invention covers a composite cermet body of a sintered powder compact, having a core of a first cermet composition, and one or more layers of other cermet compositions surrounding the core. These outer layers are preferably coaxial with the central core, and form co-planar top and bottom surfaces with the central core, which surfaces are normal to the axis.

In a specific embodiment, the composite cermet core and layers each include at least one of the refractory metals tungsten and molybdenum, and aluminum oxide.

The invention also covers a polycrystalline alumina arc tube for a metal halide arc discharge lamp, in which the tube is sealed with at least one closure member of a composite cermet having a central core containing refractory metal in an amount to make it sufficiently electrically conductive to provide operating current to an arc tube electrode, and having at least one outer layer containing alumina in an amount to provide a thermal expansion coefficient which is compatible with that of the arc tube wall.

In another aspect of the invention, a process for producing composite cermet bodies includes: (1) pressing a first cermet powder composition to form a powder compact having a central cavity opening into the top and bottom surfaces of the compact; (2) filling the cavity with a second cermet powder composition; (3) pressing the powder-filled compact to form a green composite; and (4) sintering the composite to form an integral cermet body.

DESCRIPTION OF THE PREFERRED EMBODIMENTS

Figure 1:
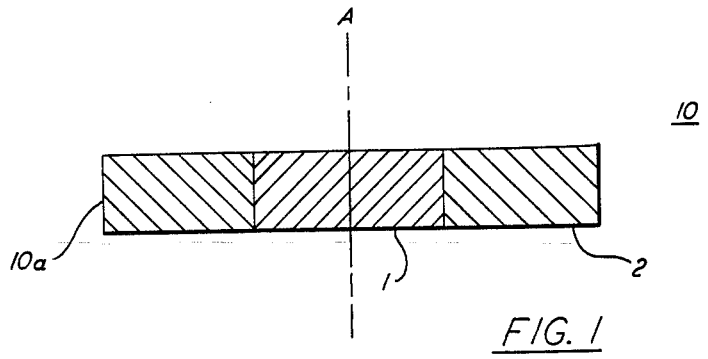
FIG. 1 is a front elevation view, in section, of a composite cermet body of the invention.

FIG. 1 illustrates, in cross-section, one embodiment 10 of the cermet composites of the invention, in which cylindrical core 1 of a first cermet composition, having central axis A, is surrounded by coaxial annular layer 2 of a second cermet composition. Typically, both compositions contain the same constituents, but in different proportions, in order to provide a gradation of one or more physical, chemical or electrical properties from the center to the outer wall 10*a* of the cermet. As will be appreciated, finer gradations can be achieved by increasing the number of layers surrounding the core, and progressively increasing one or more constituents at the expense of the remaining constituents, from layer to layer. Where the gradations are sufficiently fine and sintering is carried out for a time sufficient to produce substantial diffusion of constituents between layers, it is possible to achieve a continuous gradation of composition and properties from center to outer wall. Such continuous gradation may be desired for the most demanding applications. Further control over the properties of the cermet can be achieved by varying the constituents so that each layer does not necessarily contain the same constituents. For example, in a composite having two layers surrounding a core, the outer layer may contain constituents A and B, the inner layer B and C, and the core C and D.

In order to illustrate the concept and application of a concentrically graded composite, it is helpful to describe an exemplary situation in which a particular composite is used to fulfill specific requirements.

Figure 2:
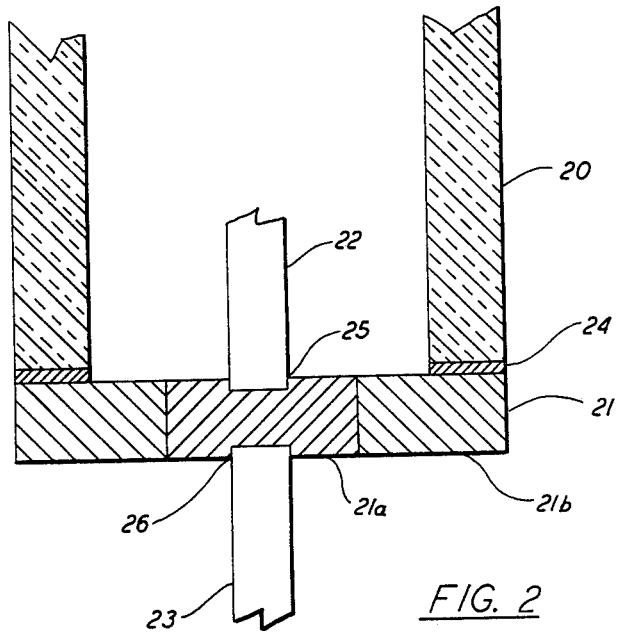
FIG. 2 is a front elevation view partly in section, of an alumina arc tube having an end closure of a composite cermet of the type shown in FIG. 1, including embedded metal electrodes.

FIG. 2 shows a portion of an alumina arc tube 20, suitable for use in a metal halide arc discharge lamp. The tube is typically filled with one or more metal halides, mercury and argon, and has a pair of electrodes, not shown, between which an illuminating arc is sustained during operation. Because of the large difference in thermal expansion coefficients between the ceramic arc tube and the metal leads for the electrodes, it is difficult to achieve with a single closure material a hermetic seal which is reliable both at the arc tube end wall and surrounding the lead wire.

A comprimise is achieved, where a concentrically graded composite cermet is used. We have succeeded in producing such a composite which has a central conductive core of about 10 to 30 volume percent tungsten, remainder $Al_2O_3$, surrounded by an annulus of about 5 to 10 volume percent tungsten, remainder $Al_2O_3$.

A composite cermet closure element 21 is illustrated in FIG. 2, having core 21*a* of relatively high thermal expansion coefficient and annulus 21*b* of relatively low thermal expansion coefficient, surrounding the core. In addition, the composite nature of the cermet enables the core to have sufficient electrical conductivity so that it is unnecessary for the electrode lead wire to pass through the closure element 21. In the embodiment of FIG. 2, separate tungsten lead wires 22 and 23 are secured by embedment into opposing surfaces of the closure element 21, thus providing a conducting path to the electrode, not shown, without the risk of failure of the hermetic seal which would occur for a pass-through lead.

The closure element 21 is hermetically sealed to the end wall of the arc tube 20 by means of sealing glass 24. Such glass must soften at a sufficiently low temperature that it does not attack the alumina tube, and must also be impervious to the fill materials. Many such sealing glass compositions are known. One suitable composition is a lanthanum oxide-based frit having in weight percent: 86.5% $La_2O_3$, 10.0% $B_2O_3$, 1.5% $P_2O_5$, 1.5% $Al_2O_3$, 0.5% MgO.

Figure 3:
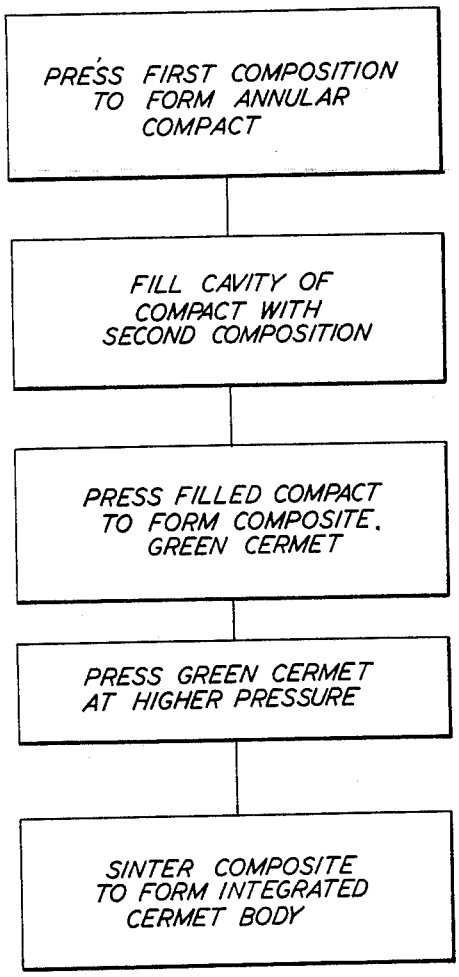
FIG. 3 is a block flow diagram illustrating one embodiment of a process for producing a composite cermet of the invention.

The composite cermets of the invention are conveniently formed by first pressing an annular compact of the outer layer, then filling the cavity of the compact with a different powder composition, and pressing again to form a green composite. FIG. 3 illustrates an especially preferred process in which the green composite is pressed at a higher pressure before sintering to form an integral cermet body. Sintering is preferably carried out in a non-oxidizing atmosphere, in order to prevent oxidation of the metallic constituents. For the structure illustrated in FIG. 2, depressions 25 and 26 are formed in the composite during the second pressing, and then lead wires 22 and 23 are pressed into the compact during the final pressing, and sintered in place during a single sintering step, typically carried out at a temperature between 1500° C. and 1800° C.

An exemplary procedure for preparing a composite cermet according to the invention is as follows:

The raw materials for these samples were $Al_2O_3$ (Linde A, Union Carbide, 0.3 μm) and powdered W metal (Fisher purified, 0.5 μm) Two batches were mixed by tumbling for 17 hours; one batch was 20% W/Vol., and the other was 7½% W/Vol. Homogeneous cermets previously made from these batches showed resistivities of 0.029 Ωcm and $2\times10^{11}$ Ωcm, respectively. Composite samples were made by first uniaxially pressing a short hollow cylinder ½" in diameter with a ¼" central opening at 500 to 1000 psi from the 7½ percent W/Vol. batch. The central opening was filled with 20 percent W/Vol. material and pressed at the same pressure. The whole composite was then pressed at approximately 15,000 psi. This composite was sintered in vacuum at 1650° C. for 1 hour. Resistivity measurements by a four-point probe technique on three samples prepared as described yielded results of 79, 51, and 17 Ωcm. These results are for the whole composite; the core itself would show lower values as described above. Resistivity can be altered as desired by using a larger conductive core or one of higher metal content. In addition, more than two layers may be used in a single composite if greater differences in properties are required between inner and outer layers. In the pressing process, the central plug may be pressed at low pressures (<1000 psi) to a size slightly smaller than the cylinder opening. The plug may then be inserted into this opening, and the composite may be pressed at up to 15,000 psi.

The above example cites only one application of the composites disclosed here. Other composite compositions may include layers grading from one oxide to another, from oxide to metal as above, or from one metal to another. Such compositions are capable of yielding gradation in resistivity, chemical compatibility characteristics, or physical properties such as thermal expansion, density, thermal conductivity, etc. Thus, layers may be chosen such that the finished composite performs different functions in different layers, depending upon the requirements of the particular application.

What is claimed is:

1. A composite sintered cermet body comprising a core portion of a first cermet composition having a central axis, and one or more layers of other cermet compositions surrounding the core and substantially coaxial therewith, the top and bottom surfaces being substantially planar and normal to the axis.

2. The body of claim 1 in which the core is cylindrical, and the layers surrounding the core are annular.

3. The body of claim 1 in which the core and one or more layer compositions each comprise at least one refractory metal selected from the group consisting of tungsten and molybdenum and aluminum oxide.

4. The body of claim 3 in which the core consists essentially of from about 10 to 30 volume percent of said refractory metal, remainder aluminum oxide, and in which one layer surrounds the core, the layer consisting essentially of from about 5 to 10 volume percent of said refractory metal, remainder aluminum oxide.

5. The body of claim 4 in which the core consists essentially of about 20 volume percent tungsten, remainder aluminum oxide, and the layer consists essentially of about 7½ volume percent tungsten, remainder aluminum oxide.

6. A composite sintered cermet body having a central axis, planar top and bottom surfaces normal to the axis, and an annular outer wall surrounding the axis, characterized in that the composition of the cermet changes substantially continuously, radially outward from the central axis to the outer wall.

7. A process for producing a composite cermet body, comprising the steps of:

(1) pressing a first cermet powder composition to form a powder compact having a central cavity opening into the top and bottom surfaces of the compact;

(2) filling the cavity with a second cermet powder composition;

(3) pressing the powder filled compact to form a green composite; and (4) sintering the composite to form an integral cermet body.

8. The process of claim 7 in which the compact is formed at a pressure of from about 500 to 1000 psi.

9. The process of claim 8 in which the green composite is formed by a two-step pressing, the first pressing step carried out at a relatively low pressure, and the second step carried out at a higher pressure.

10. The process of claim 9 in which the first pressing is carried out at a pressure of from about 500 to 1000 psi, and the second pressing is carried out at a pressure of from about 10,000 to 20,000 psi.

11. The process of claim 7 in which each cermet composition consists essentially of a refractory metal selected from the group consisting of tungsten and molybdenum, and aluminum oxide, and in which sintering is carried out in a non-oxidizing atmosphere at a temperature within the range of about 1500° C. to 1800° C.

12. The process of claim 8 in which depressions are formed in opposing surfaces of the core during the first pressing, electrical lead wires are embedded in the depressions during the second pressing, and the wires are bonded to the composite during sintering.

* * * * *